US009459078B1

(12) United States Patent
Kincel

(10) Patent No.: US 9,459,078 B1
(45) Date of Patent: Oct. 4, 2016

(54) ACCESSORY MOUNTING MECHANISM FOR FIREARM

(71) Applicant: Bravo Company USA, Inc., Hartland, WI (US)

(72) Inventor: Eric Stephen Kincel, Las Vegas, NV (US)

(73) Assignee: BRAVO COMPANY MFG, INC., Hartland, WI (US)

( * ) Notice: Subject to any disclaimer, the term of this patent is extended or adjusted under 35 U.S.C. 154(b) by 0 days.

(21) Appl. No.: 14/823,876

(22) Filed: Aug. 11, 2015

(51) Int. Cl.
*F41G 11/00* (2006.01)

(52) U.S. Cl.
CPC ..... *F41G 11/004* (2013.01)

(58) Field of Classification Search
CPC ..... F41G 11/005; F41G 11/004
USPC ..... 42/90, 124, 127, 147, 148, 114, 131, 42/111, 115, 128, 133, 136
See application file for complete search history.

(56) References Cited

U.S. PATENT DOCUMENTS 7,971,384 B2 * 7/2011 Lippard ..... F41G 11/007 42/124
8,312,668 B2 11/2012 Kincel
8,490,316 B2 7/2013 Kincel et al.
2010/0122485 A1 * 5/2010 Kincel ..... F41G 11/004 42/146
2013/0104441 A1 * 5/2013 Kincel ..... F41G 11/004 42/90
2013/0133238 A1 * 5/2013 Quetschke ..... F41A 35/00 42/90
2013/0318848 A1 * 12/2013 Kincel ..... B65D 45/00 42/90
2014/0204566 A1 * 7/2014 Kay ..... F41C 27/00 362/110

* cited by examiner

*Primary Examiner* — Samir Abdosh
*Assistant Examiner* — John D Cooper
(74) *Attorney, Agent, or Firm* — Howard & Howard Attorneys PLLC

(57) ABSTRACT

An accessory mounting mechanism with a top portion consisting of a ring and a bottom portion consisting of a clamp is disclosed. The ring accepts an accessory. The ring is coupled to a clamp, which is configured to engage a firearm. The clamp further includes at least two detachable wedges, a cross bar, and a tightening mechanism, which may be either a thumb nut or a throw lever. The cross bar is threaded through both detachable wedges. Tightening by way of the thumb nut or the throw lever applies force against the wedges and the firearm simultaneously, which pushes the accessory upward into the ring and secures the clamp to the firearm.

25 Claims, 16 Drawing Sheets

ACCESSORY MOUNTING MECHANISM FOR FIREARM

TECHNICAL FIELD

The subject invention generally concerns firearm equipment. More particularly, the present invention relates to an accessory mounting mechanism for a firearm.

BACKGROUND OF THE INVENTION

Firearm users utilize a variety of accessories that are mountable to the firearm, including flashlights, otherwise known as tactical lights. Tactical lights are used to assist the user in identifying a target in low-light conditions. Tactical lights may also be flashed in the target's eyes to temporarily blind or disorient the target. Other accessories may include lasers (used for aiming) and cameras.

There are several known accessory mounting mechanisms. For example, the Scout Mount by Vltor utilizes a pivoting rail clamp with ring. The ring fits around the body of a light. The bottom of the ring contains a clamp that is designed to attach to a rail, such as a Picatinny rail. When the user mounts the clamp to the rail, the user applies force to the clamp against the rail and tightens the clamp. When the clamp cannot be tightened any further, the clamp pivots. The remaining force is applied to the clamping of the ring around the body of the light to ensure the light is securely coupled to the rail.

Another mechanism by Vltor, the Offset Scout Mount (U.S. Pat. No. 8,312,668, issued Nov. 20, 2012 to Eric Stephen Kincel), is ambidextrous and utilizes a throw lever and thumb knobs. Instead of being directly mounted over the rail, this mount is offset and allows the user to apply force equally to the rail and to the accessory during the mounting process.

The Adjustable Scout Mount, also by Vltor (U.S. Pat. No. 8,490,316, issued Jul. 23, 2013 to Eric Stephen Kincel et al.) utilizes a clamp, and further includes a single wedge and bracket. The user forces the wedge up a ramp on the clamp and secures the clamp by compressing the rail between a bracket.

The above-described mechanisms, incorporated herein by reference, allow the attachment and removal of accessories, such as flashlights, to the rail. However, the process of mounting the accessory to the rail is time-consuming and not user-friendly. This is especially detrimental under conditions where ease of use and speed are essential, such as when the user is actively engaged in combat, self-defense, or law enforcement activities.

The present invention is aimed at one or more of the problems identified above.

BRIEF DESCRIPTION OF THE DRAWINGS

Other advantages of the present invention will be readily appreciated as the same becomes better understood by reference to the following detailed description when considered in connection with the accompanying drawings wherein.

Corresponding reference characters indicate corresponding parts throughout the drawings.

SUMMARY OF THE INVENTION

An accessory mounting mechanism with a ring and a clamp is disclosed. A hollow ring accepts an accessory. The hollow ring is coupled to a clamp, which is configured to engage a rail, such as a Picatinny rail. The clamp further includes at least two wedges and a tightening mechanism, which may be a thumb nut. Tightening of the clamp by the thumb nut applies force against the wedges and the rail simultaneously, which pushes the accessory upward into the ring and secures the clamp to the rail.

An accessory mounting mechanism with a ring and a clamp is disclosed. A hollow ring accepts an accessory. The hollow ring is coupled to a clamp, which is configured to engage a rail, such as a Picatinny rail. The clamp further includes at least two wedges and a tightening mechanism, which may be a throw lever. Tightening of the clamp by the throw lever applies force against the wedges and the rail simultaneously, which pushes the accessory upward into the ring and secures the clamp to the rail.

An accessory mounting mechanism with a ring and a clamp is disclosed. A hollow ring accepts an accessory. The hollow ring is coupled to a clamp, which is configured to engage a rail, such as a KeyMod rail. The clamp further includes at least two wedges and a tightening mechanism, which may be a thumb nut. Tightening of the clamp by the thumb nut applies force against the wedges and the rail simultaneously, which pushes the accessory upward into the ring and secures the clamp to the rail.

An accessory mounting mechanism with a ring and a clamp is disclosed. A hollow ring accepts an accessory. The hollow ring is coupled to a clamp, which is configured to engage a rail, such as a KeyMod rail. The clamp further includes at least two wedges and a tightening mechanism, which may be a throw lever. Tightening of the clamp by the throw lever applies force against the wedges and the rail simultaneously, which pushes the accessory upward into the ring and secures the clamp to the rail.

DETAILED DESCRIPTION OF THE INVENTION

With reference to the drawings and in operation, the present invention overcomes at least some of the disadvantages of known accessory mounts. Various embodiments of the present invention allow the user to apply force equally to the body of the accessory and the rail interface at the same time.

Accessory Mount with Thumb Nut for Picatinny Rail

Figure 1A:
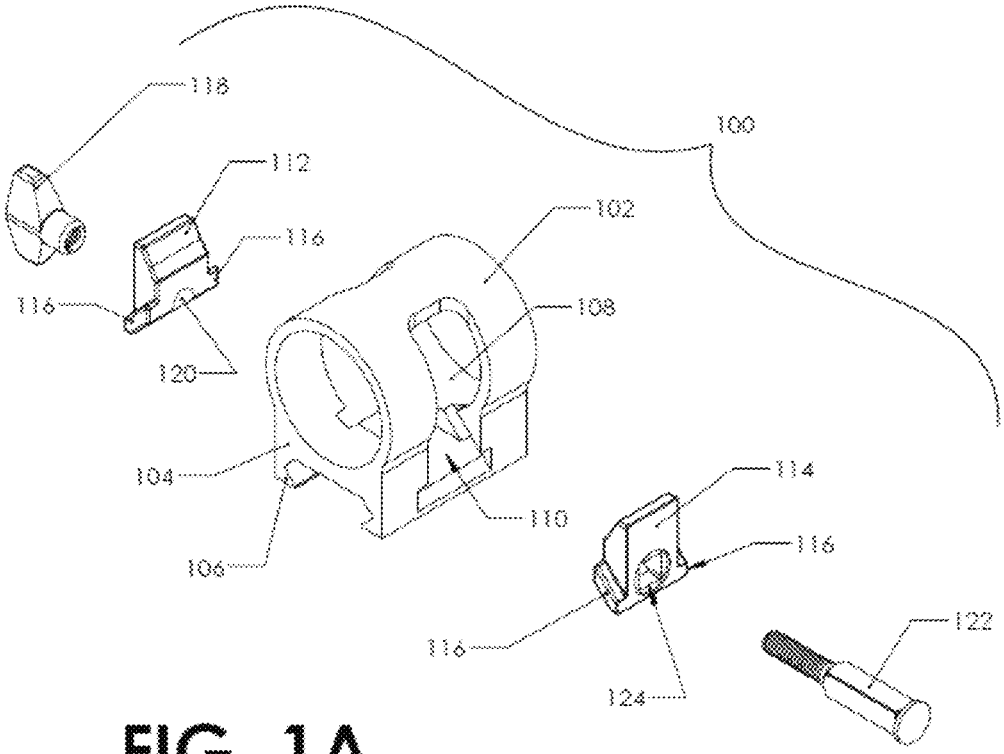
FIG. 1A is an exploded perspective view of an accessory mount with thumb nut for a Picatinny rail.

Referring now to FIG. 1A, an exploded perspective view of an accessory mount with thumb nut for a Picatinny rail is shown. A mount 100 consists of a top portion including a hollow ring 102 and a bottom portion including a clamp 104. Ring 102 is configured to accept a body of an accessory (not shown). The accessory may be any accessory with a body that fits into ring 102, such as but not limited to a light, a laser, or a camera. Clamp 104 includes two teeth 106 to engage a rail (not shown). The rail may be a Picatinny 1913 MilSpec rail, also known simply as a MIL-STD-1913 rail or simply a Picatinny rail. Alternatively, the rail may be any rail having a similar trapezoidal design.

Clamp 104 includes two apertures 108. The bottom of each aperture 108 comprises a ramp, one of which is labeled 110. A first wedge 112 and a second wedge 114 are configured to fit into apertures 108 on top of ramps 110. Each wedge 112 and 114 includes two ears 116. When wedges 112 and 114 are placed inside apertures 108, ears 116 connect wedges 112 and 114 to mount 100. A thumb nut 118 is configured to connect to first wedge 112 through a first wedge aperture 120. A screw 122 is threaded through second wedge 114 by second wedge aperture 124, through clamp 104 and first wedge aperture 120, and into thumb nut 118. Screw 122 may be a square cut screw, which acts as a recoil lug. The square profile also provides torque resistance so that tools are not required to assemble the screw and thumb nut mechanism. In an alternate embodiment, a portion of thumb nut 118 that connects through first wedge aperture 120 may include a threaded shaft or a threaded screw.

Figure 1B:
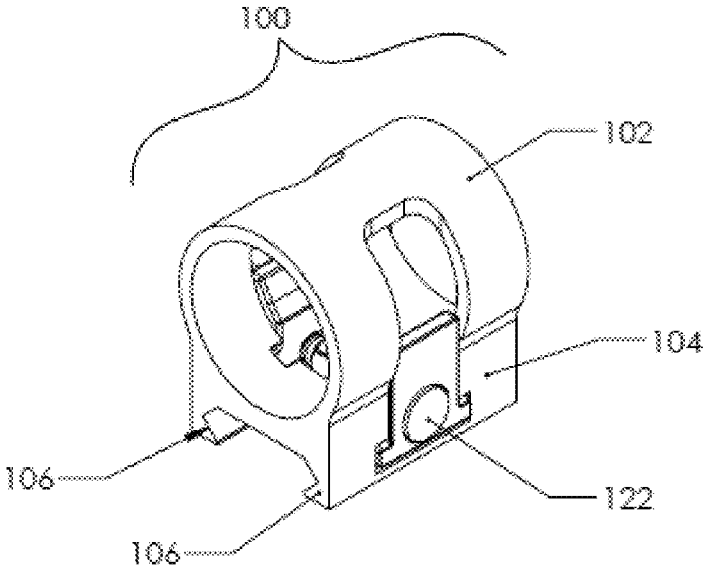
FIG. 1B is a perspective view of a fully assembled accessory mount with thumb nut for a Picatinny rail.

Referring now to FIG. 1B, a perspective view of a fully assembled accessory mount with thumb nut for a Picatinny rail is shown. As the screw-thumb nut mechanism of clamp 104 is being assembled by the user, as described above, force is applied against the accessory body and the upper 45-degree angles of the rail. As the wedges apply force to the upper rail, the wedges 112 and 114 are equally forced against the accessory body, which in turn forces the accessory body upward into ring 102 and pinches the rail between teeth 106, securing mount 100 to the rail.

Figure 1C:
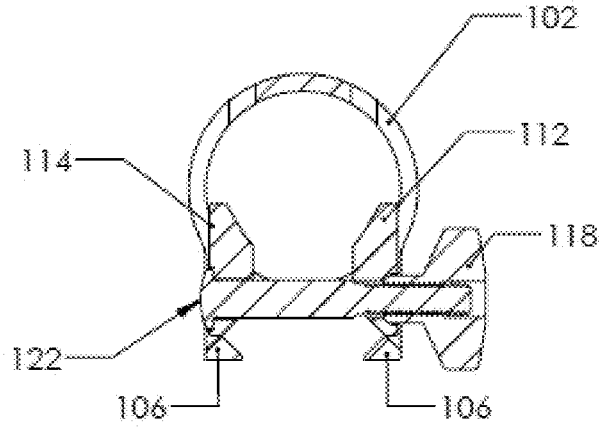
FIG. 1C is a cross-sectional front view of a fully assembled accessory mount with thumb nut for a Picatinny rail.

Referring now to FIG. 1C, a cross-sectional front view of a fully assembled accessory mount with thumb nut for a Picatinny rail is shown.

Figure 1D:
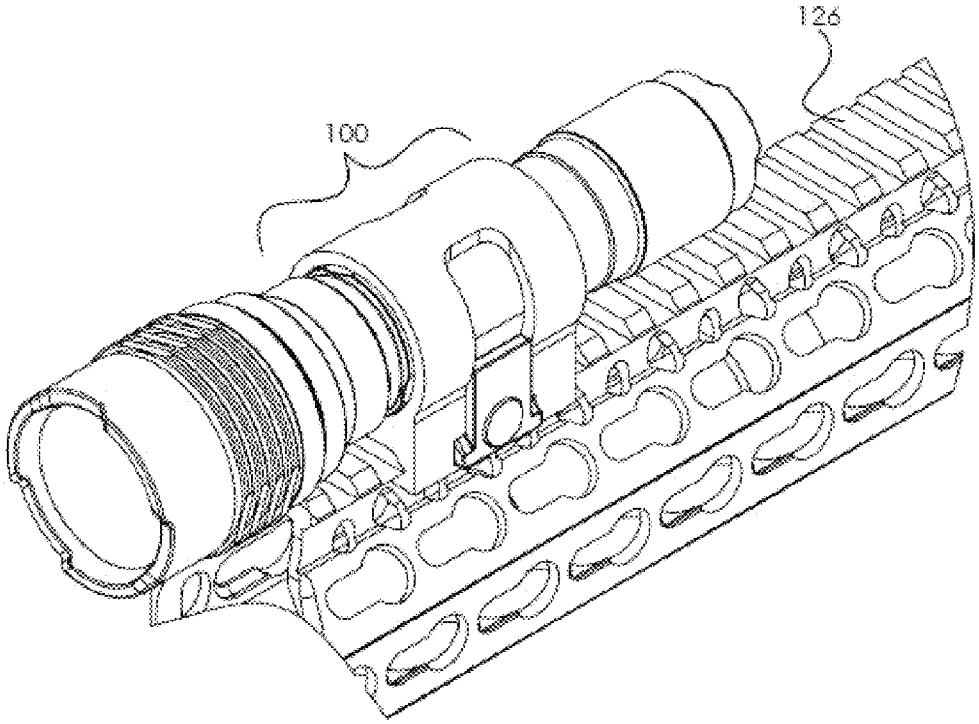
FIG. 1D is a perspective view of a fully assembled accessory mount with thumb nut on a partial exemplary Picatinny rail.

Referring now to FIG. 1D, a perspective view of a fully assembled accessory mount with thumb nut on a partial exemplary Picatinny rail is shown. In this view, mount 100 is secured to a Picatinny rail 126, using the mechanism described above and shown in FIGS. 1A-1C. Picatinny rail 126 is then secured to a firearm (not shown), which may be, for example, a rifle or similar firearm, such as the M-16 rifle, AR-15 rifle, M-4 carbine, or Short Barreled Rifle (SBR).

Accessory Mount with Throw Lever for Picatinny Rail

Figure 2A:
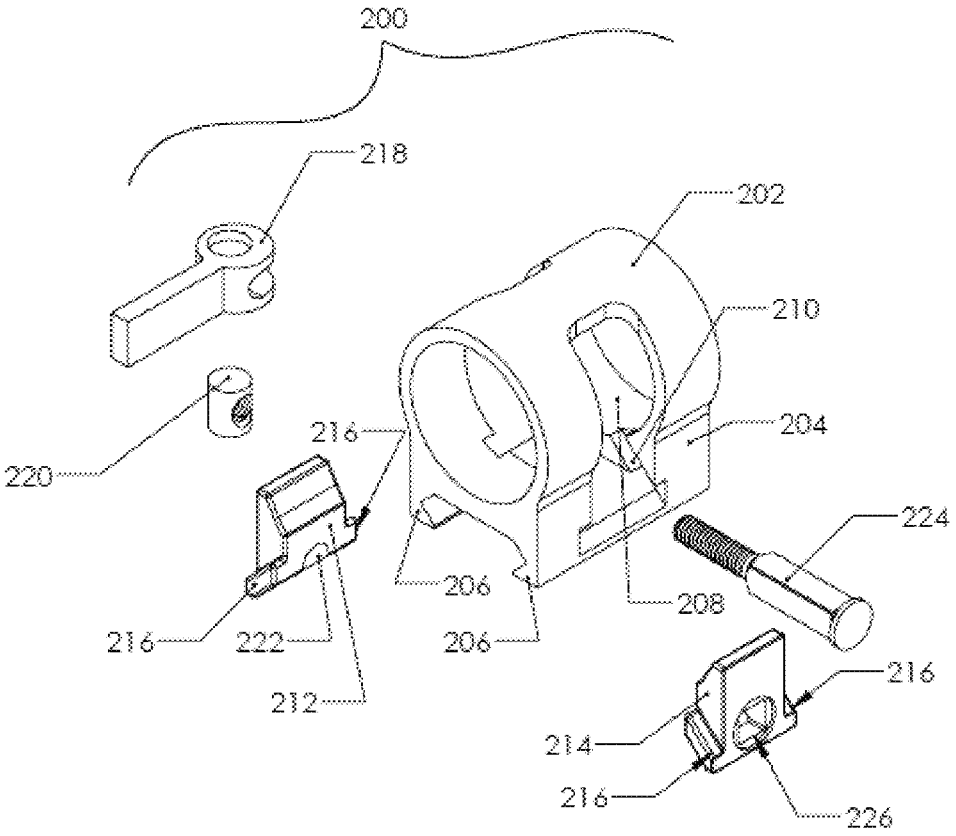
FIG. 2A is an exploded perspective view of an accessory mount with throw lever for a Picatinny rail.

Referring now to FIG. 2A, an exploded perspective view of an accessory mount with throw lever for a Picatinny rail is shown. A mount 200 consists of a top portion including a hollow ring 202 and a bottom portion including a clamp 204. Ring 202 is configured to accept a body of an accessory (not shown). The accessory may be any accessory with a body that fits into ring 202, such as but not limited to a light, a laser, or a camera. Clamp 204 includes two teeth 206 to engage a rail (not shown). The rail may be a Picatinny 1913 MilSpec rail, also known simply as a MIL-STD-1913 rail or simply a Picatinny rail. Alternatively, the rail may be any rail having a similar trapezoidal design.

Clamp 204 includes two apertures 208. The bottom of each aperture 208 comprises a ramp, one of which is labeled 210. A first wedge 212 and a second wedge 214 are configured to fit into apertures 208 on top of ramps 210. Each wedge 212 and 214 includes two ears 216. When wedges 212 and 214 are placed inside apertures 208, ears 216 connect wedges 212 and 214 to mount 200.

A throw lever 218 is configured to receive nut 220. Throw lever 218 may be a quick detachable throw lever, pre-adjusted (by screw and nut) for proper tension. Nut 220 is placed adjacent to first wedge 212 by a first wedge aperture 222. A cross bar 224 is threaded through second wedge 214 by second wedge aperture 226, through clamp 204 and first wedge aperture 222, and into nut 220 contained by throw lever 218. Cross bar 224 may be adjusted to fine-tune the clamping mechanism.

Figure 2B:
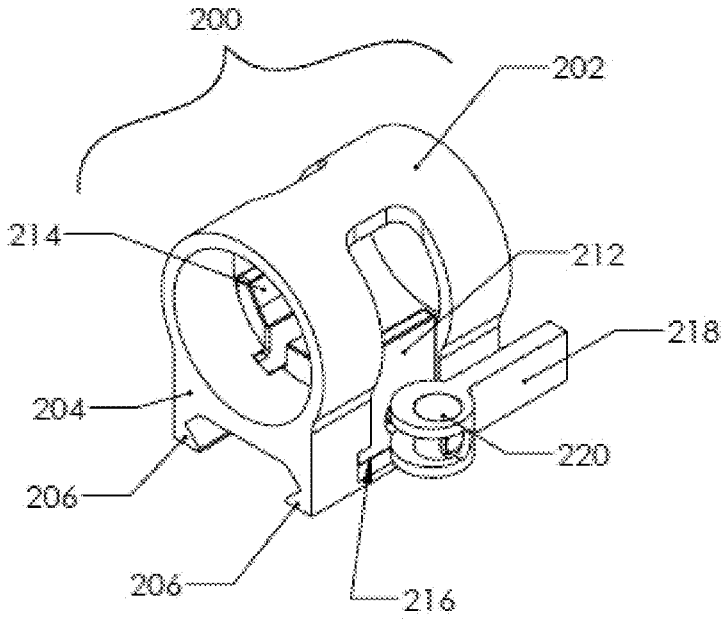
FIG. 2B is a perspective view of a fully assembled accessory mount with throw lever for a Picatinny rail.

Referring now to FIG. 2B, a perspective view of a fully assembled accessory mount with throw lever for a Picatinny rail is shown.

Figure 2C:
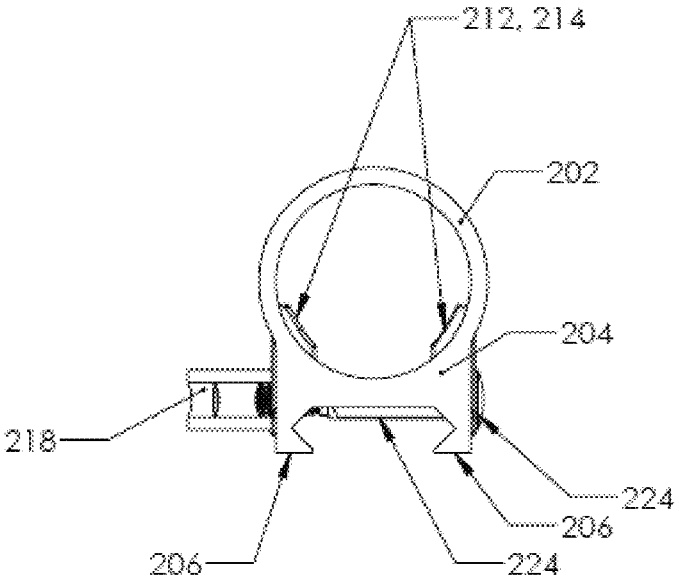
FIG. 2C is a front view of a fully assembled accessory mount with throw lever for a Picatinny rail in the "closed" position.
Figure 2D:
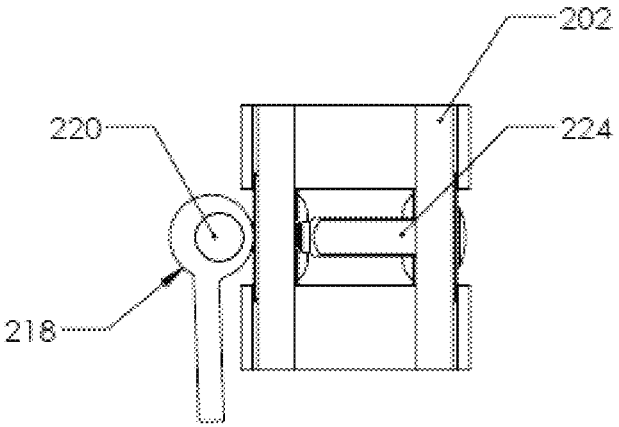
FIG. 2D is a bottom view of a fully assembled accessory mount with throw lever for a Picatinny rail in the "closed" position.
Figure 2E:
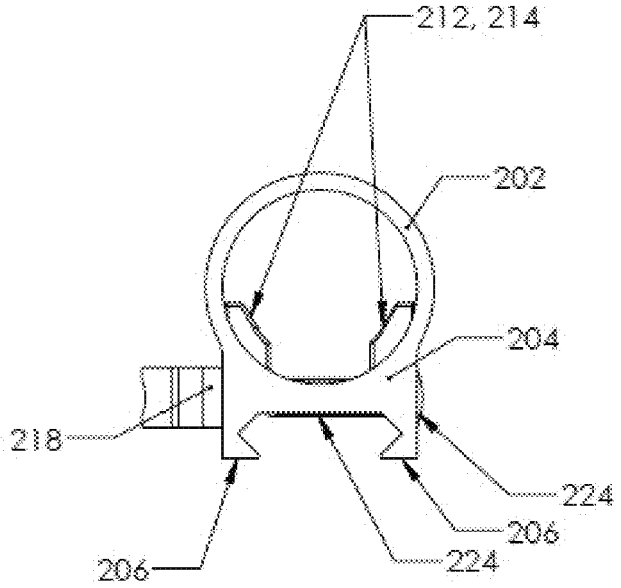
FIG. 2E is a front view of a fully assembled accessory mount with throw lever for a Picatinny rail in the "open" position.
Figure 2F:
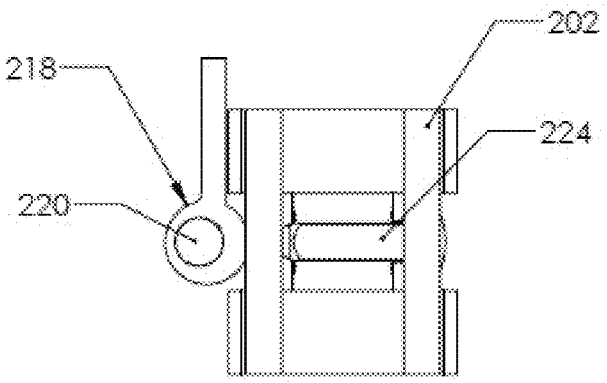
FIG. 2F is a bottom view of a fully assembled accessory mount with throw lever for a Picatinny rail in the "open" position.

Referring now to FIGS. 2C-2D, a front view and a bottom view of a fully assembled accessory mount with throw lever for a Picatinny rail in the "closed" position are shown. Referring now to FIGS. 2E-2F, a front view and a bottom view of a fully assembled accessory mount with throw lever for a Picatinny rail in the "open" position are shown.

As lever 218 is moved from an "open" to a "closed" position, force is applied against the accessory body and the upper 45 degree angles of the rail. As the wedges 212 and 214 apply force to the upper rail, wedges 212 and 214 are equally forced against the accessory body, which in turn forces the accessory body upward into ring 202 and pinches the rail between teeth 206, securing mount 200 to the rail.

Accessory Mount with Thumb Nut for KeyMod Rail

Figure 3A:
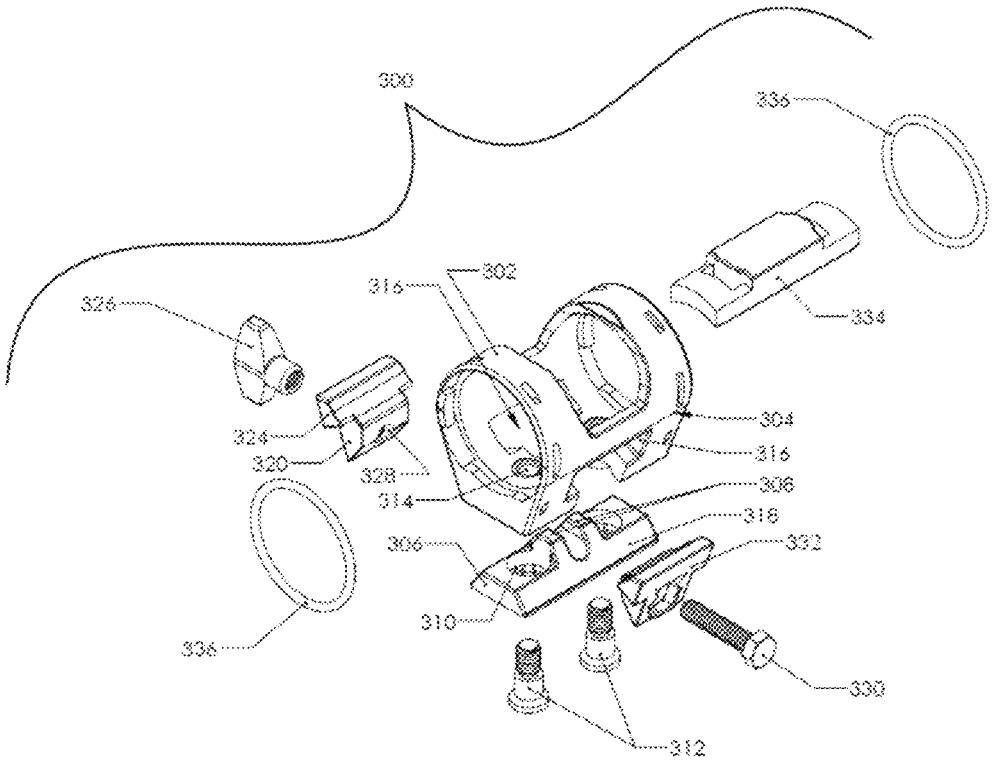
FIG. 3A is an exploded perspective view of an accessory mount with thumb nut for a KeyMod rail.

Referring now to FIG. 3A, an exploded perspective view of an accessory mount with thumb nut for a KeyMod rail is shown. A mount 300 consists of a top portion including a hollow ring 302 and a bottom portion including a clamp 304. Clamp 304 includes a detachable base 306. Ring 302 is configured to accept a body of an accessory (not shown).

The accessory may be any accessory with a body that fits into ring 302, such as but not limited to a light, a laser, or a camera.

Base 306 includes two teeth 308 to engage the non-detachable portion of clamp 304. Base 306 further includes at least two base apertures 310, through which at least two anchors 312 are threaded. Anchors 312 are then threaded through at least two clamp apertures 314. Anchors 312 are coupled to a rail (not shown), and are used to secure base 306, clamp 304, and ring 302 to the rail. The rail may be a KeyMod rail, as is well known in the art, or any other rail utilizing similar key-hole mounting slots.

The non-detachable portion of clamp 304 includes two apertures 316. The sides of base 306 comprise ramps, one of which is labeled 318. A first wedge 320 and a second wedge 322 are configured to fit into apertures 316 on top of ramps 318. Each wedge 320 and 322 includes two ears 324. When wedges 320 and 322 are placed inside apertures 316, ears 324 connect wedges 320 and 322 to mount 300.

A thumb nut 326 is configured to connect to first wedge 320 through a first wedge aperture 328. The portion of thumb nut 326 that connects through first wedge aperture 328 may include a threaded shaft or a threaded screw. A screw 330 is threaded through second wedge 322 by second wedge aperture 332, through between teeth 308 and first wedge aperture 328, and into thumb nut 326. Screw 330 may be a square cut screw. The square profile also provides torque resistance so that tools are not required to assemble the screw and thumb nut mechanism.

Shim 334 may optionally be placed within the hollow space of ring 302 to allow accessories with smaller bodies to fit through ring 302.

In one embodiment, O-rings 336 may be utilized at either end of ring 302 to prevent rotation and friction of the accessory body.

Figure 3B:
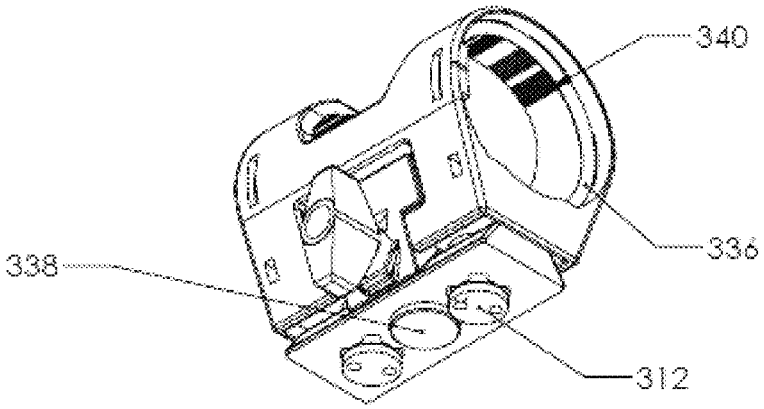
FIG. 3B is a perspective view of a fully assembled accessory mount with thumb nut for a KeyMod rail.

Referring now to FIG. 3B, a perspective view of a fully assembled accessory mount with thumb nut for a KeyMod rail is shown. As the screw-thumb nut mechanism of clamp 304 is being assembled by the user, as described above, force is applied against the accessory body and the rail. As wedges 320 and 322 apply force to the base, wedges 320 and 322 are equally forced against the accessory body, which in turn forces the accessory body upward into ring 302. At the same time, base 306 is pushed downward, engaging the rail, and anchors 312 are effectively shortened as they are pulled up through base 306. Base 306 further includes recoil lug 338, which is located between anchors 312 and indexes mount 300 with the rail. Recoil lug 338 prevents mount 300 from shifting forward and aft on the rail, which may otherwise occur due to recoil and counter-recoil produced by the firearm.

Optionally, the inner surfaces of ring 302 may contain serrations 340 to prevent rotation and friction of the accessory body. Base 306 may optionally include relief apertures to avoid the buildup of dirt and debris, which could prevent the proper functioning of the mechanism.

Figure 3C:
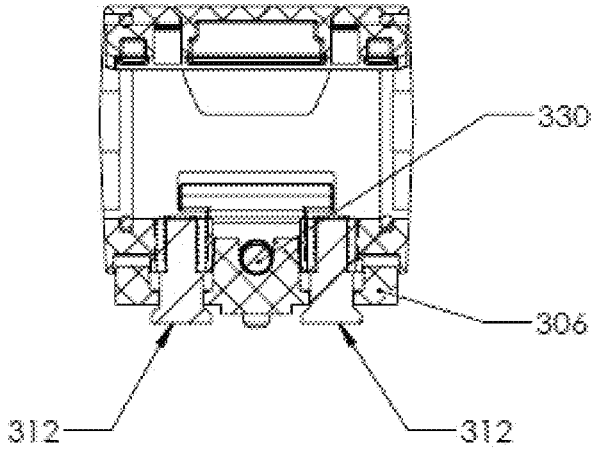
FIG. 3C is a cross-sectional side view of a fully assembled accessory mount with thumb nut for a KeyMod rail.
Figure 3D:
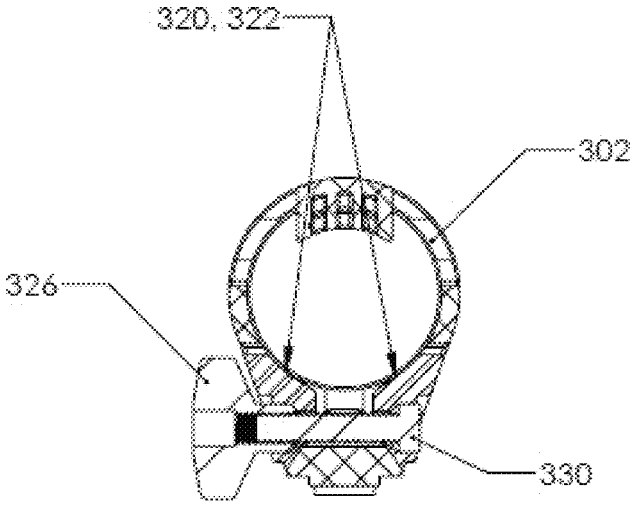
FIG. 3D is a cross-sectional front view of a fully assembled accessory mount with thumb nut for a KeyMod rail.

Referring now to FIG. 3C, a cross-sectional side view of a fully assembled accessory mount with thumb nut for a KeyMod rail is shown. FIG. 3D shows a cross-sectional front view of a fully assembled accessory mount with thumb nut for KeyMod rail.

Figure 3E:
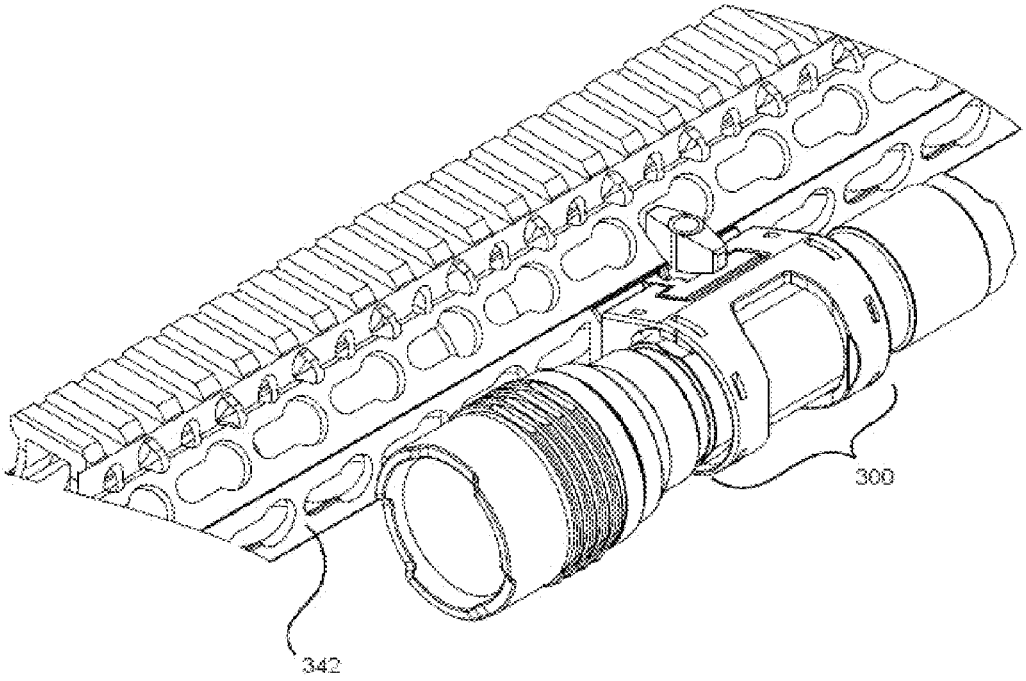
FIG. 3E is a perspective view of a fully assembled accessory mount with thumb nut on a partial exemplary KeyMod rail.

Referring now to FIG. 3E, a perspective view of a fully assembled accessory mount with thumb nut on a partial exemplary KeyMod rail is shown. In this view, mount 300 is secured to a KeyMod rail 340, using the mechanism described above and shown in FIGS. 3A-3D. KeyMod rail 340 is then secured to a firearm (not shown), which may be, for example, a rifle or similar firearm, such as the M-16 rifle, AR-15 rifle, M-4 carbine, or Short Barreled Rifle (SBR).

Accessory Mount with Throw Lever for KeyMod Rail

Figure 4A:
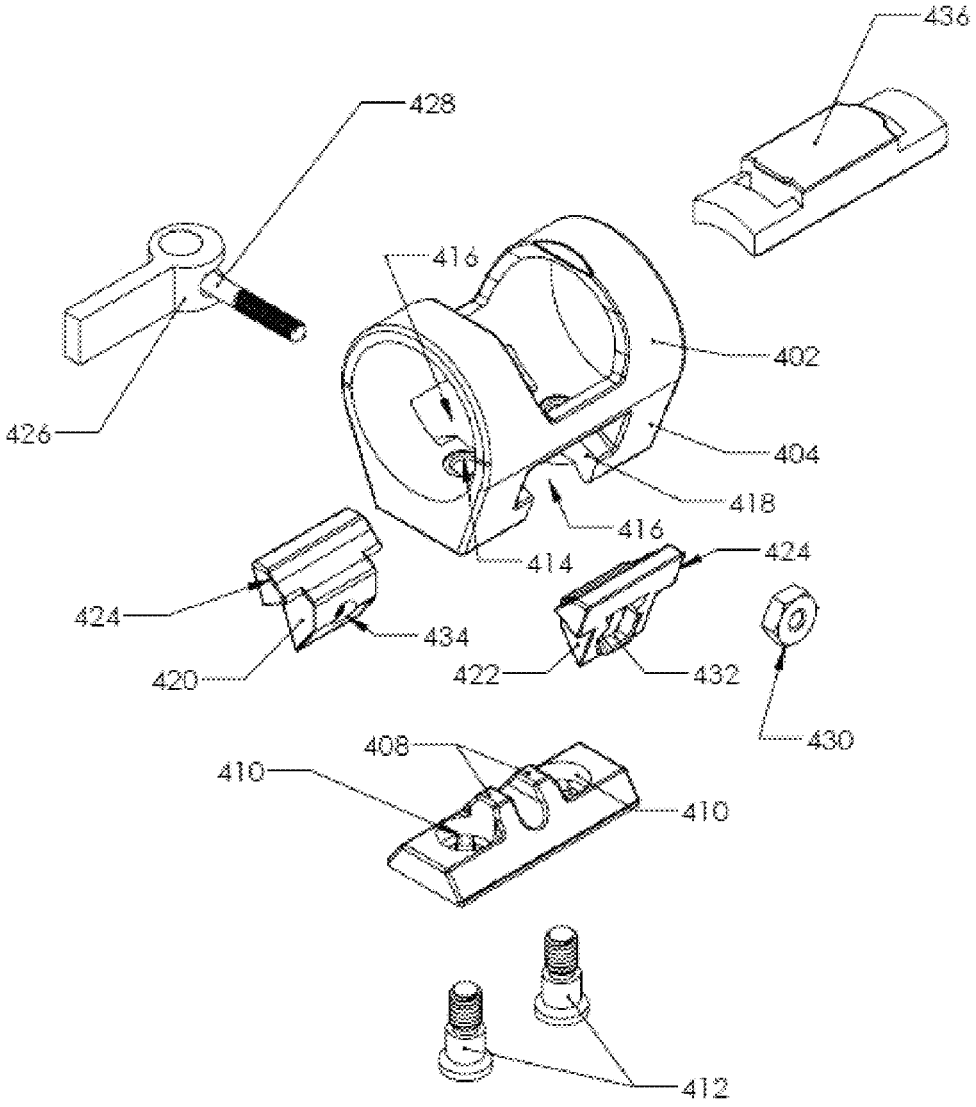
FIG. 4A is an exploded perspective view of an accessory mount with throw lever for a KeyMod rail.

Referring now to FIG. 4A, an exploded perspective view of an accessory mount with throw lever for a KeyMod rail is shown. A mount 400 consists of a top portion including a hollow ring 402 and a bottom portion including a clamp 404. Clamp 404 includes a detachable base 406. Ring 402 is configured to accept a body of an accessory (not shown). The accessory may be any accessory with a body that fits into ring 402, such as but not limited to a light, a laser, or a camera.

Base 406 includes two teeth 408 to engage the non-detachable portion of clamp 404. Base 406 further includes at least two base apertures 410, through which at least two anchors 412 are threaded. Anchors 412 are then threaded through at least two clamp apertures 414. Anchors 412 are coupled to a rail (not shown), and are used to secure base 406, clamp 404, and ring 402 to the rail. The rail may be a KeyMod rail, as is well known in the art, or any other rail utilizing similar key-hole mounting slots.

Ring 402 may be comprised of any suitable material. In one embodiment, ring 402 may be comprised of a polymeric material. In this embodiment, anchors 412 require threaded inserts for support (not shown). In an alternative embodiment, ring 402 may be comprised of aluminum, in which case no threaded inserts are required for support because anchors 412 thread directly into the aluminum.

The non-detachable portion of clamp 404 includes two apertures 416. The sides of base 406 comprise ramps, one of which is labeled 418. A first wedge 420 and a second wedge 422 are configured to fit into apertures 416 on top of ramps 418. Each wedge 420 and 422 includes two ears 424. When wedges 420 and 422 are placed inside apertures 416, ears 424 connect wedges 420 and 422 to mount 400.

A throw lever 426 may be a quick detachable throw lever, pre-adjusted (by screw and nut) for proper tension. Throw lever 426 may include an attached cam-style threaded shaft 428, designed to receive nut 430. Nut 430 is placed adjacent to second wedge 422 by a second wedge aperture 432. Threaded shaft 428 is threaded through first wedge 420 by first wedge aperture 434, through clamp 404 between teeth 408, and through second wedge aperture 432, and into nut 430. Threaded shaft 428 may be adjusted to fine-tune the clamping mechanism.

Shim 436 may optionally be placed within the hollow space of ring 402 to allow accessories with smaller bodies to fit through ring 402.

Figure 4B:
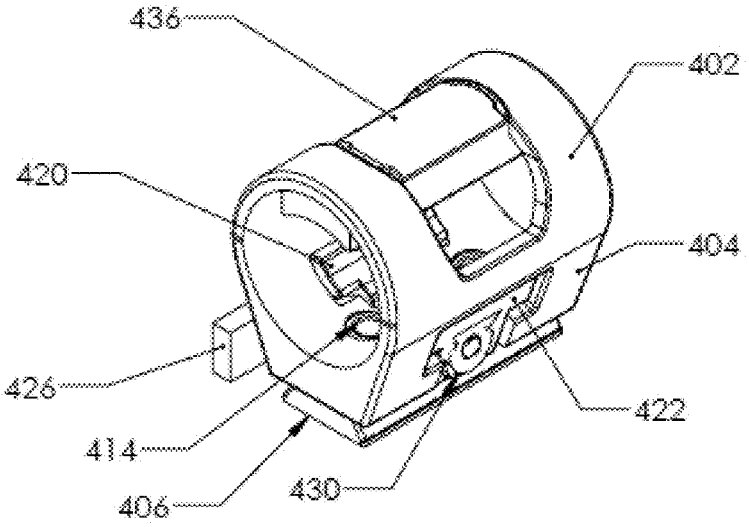
FIG. 4B is a perspective view of a fully assembled accessory mount with throw lever for a KeyMod rail.

Referring now to FIG. 4B, a perspective view of a fully assembled accessory mount with throw lever for a KeyMod rail is shown.

Figure 4C:
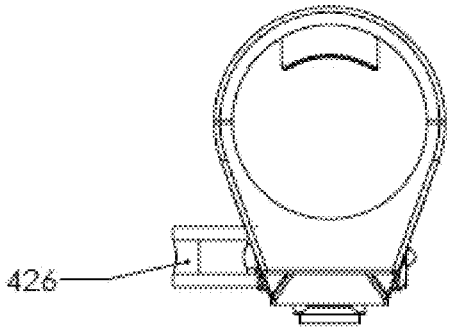
FIG. 4C is a front view of a fully assembled accessory mount with throw lever for a KeyMod rail in the "open" position.
Figure 4D:
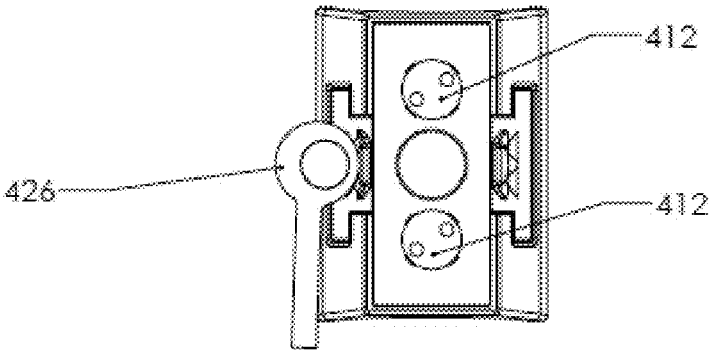
FIG. 4D is a bottom view of a fully assembled accessory mount with throw lever for a KeyMod rail in the "open" position.
Figure 4E:
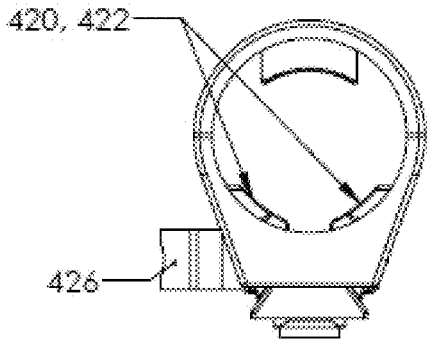
FIG. 4E is a front view of a fully assembled accessory mount with throw lever for a KeyMod rail in the "closed" position.
Figure 4F:
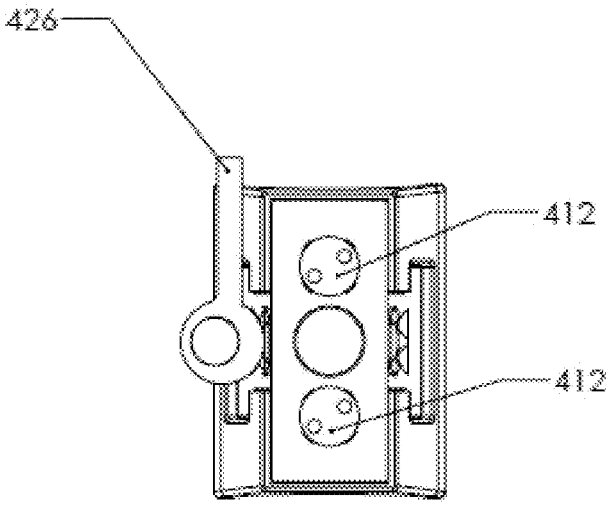
FIG. 4F is a bottom view of a fully assembled accessory mount with throw lever for a KeyMod rail in the "closed" position.

Referring now to FIGS. 4C-4D, a front view and a bottom view of a fully assembled accessory mount with throw lever for a KeyMod rail in the "open" position are shown. Referring now to FIGS. 4E-4F, a front view and a bottom view of a fully assembled accessory mount with throw lever for a KeyMod rail in the "closed" position are shown.

As throw lever 426 is moved from an "open" to a "closed" position, force is applied against the accessory body and the rail. As wedges 420 and 422 apply force to the base, wedges 420 and 422 are equally forced against the accessory body, which in turn forces the accessory body upward into ring 402. At the same time, base 406 is pushed downward, engaging the rail, and anchors 412 are effectively shortened as they are pulled up through base 406.

Obviously, many modifications and variations of the present invention are possible in light of the above teachings. In addition, the reference numerals in the claims are merely for convenience and are not to be read in any way as limiting.

What is claimed is:

1. An accessory mounting mechanism for a firearm, the mounting mechanism comprising:

a top portion forming a hollow ring for accepting an accessory; and a bottom portion consisting of a clamp coupled to the ring, wherein the clamp includes:

at least two inward-facing teeth to engage the firearm, and two detachable wedges secured into the sides of the bottom portion below the ring and above the at least two inward-facing teeth, wherein a screw is threaded through both of the two detachable wedges and into a thumb nut.

2. The accessory mounting mechanism of claim 1, wherein the firearm includes a Picatinny rail.

3. The accessory mounting mechanism of claim 2, wherein tightening the screw into the thumb nut moves the two detachable wedges toward the center of the ring, which secures the accessory in the ring.

4. The accessory mounting mechanism of claim 2, wherein tightening the screw into the thumb nut forces the at least two inward-facing teeth to engage with the rail.

5. The accessory mounting mechanism of claim 2, wherein tightening the screw into the thumb nut applies force against the two detachable wedges and the rail simultaneously, such that the pressure against the two detachable wedges forces the accessory upward into the ring and the rail is pinched between the at least two teeth, securing the clamp to the rail.

6. The accessory mounting mechanism of claim 1, wherein the accessory is a light.

7. An accessory mounting mechanism for a firearm, the mounting mechanism comprising:

a top portion forming a hollow ring for accepting an accessory; and a bottom portion consisting of a clamp coupled to the ring, wherein the clamp includes:

at least two inward-facing teeth to engage the firearm, and two detachable wedges secured into the sides of the bottom portion below the ring and above the at least two inward-facing teeth, wherein a cross bar is threaded through both of the two detachable wedges and into a nut, wherein the nut is contained within a throw lever.

8. The accessory mounting mechanism of claim 7, wherein the firearm includes a Picatinny rail.

9. The accessory mounting mechanism of claim 8, wherein the clamp is tightened by moving the throw lever from a first position to a second position.

10. The accessory mounting mechanism of claim 9, wherein the second position of the throw lever applies force against the two detachable wedges and the rail simultaneously, such that the pressure against the two detachable wedges forces the accessory upward into the ring and the rail is pinched between the at least two teeth, securing the clamp to the rail.

11. The accessory mounting mechanism of claim 7, wherein the accessory is a light.

12. An accessory mounting mechanism for a firearm, the mounting mechanism comprising:

a top portion forming a hollow ring for accepting an accessory; and a bottom portion consisting of a clamp coupled to the ring, wherein the clamp includes:

a detachable base, wherein the sides of the base form ramps, and wherein the base comprises:

at least two anchors coupled to the firearm, at least two anchors are threaded through at least two base apertures, and a non-detachable portion comprising:

at least two anchor apertures, through which the at least two anchors are threaded to couple the base to the non-detachable portion, and two detachable wedges secured into the sides of the bottom portion below the ring, wherein a screw is threaded through both of the two detachable wedges and into a thumb nut.

13. The accessory mounting mechanism of claim 12, wherein the firearm includes a KeyMod rail.

14. The accessory mounting mechanism of claim 13, wherein tightening the screw into the thumb nut forces the at least two inward-facing teeth to engage with the rail.

15. The accessory mounting mechanism of claim 13, wherein tightening the screw into the thumb nut applies force against the two detachable wedges and the base simultaneously, such that the pressure against the two detachable wedges forces the accessory upward into the ring and the base is forced downward to engage the rail, securing the clamp to the rail.

16. The accessory mounting mechanism of claim 12, wherein the accessory is a light.

17. The accessory mounting mechanism of claim 12, wherein tightening the screw into the thumb nut moves the two detachable wedges toward the center of the ring, which secures the accessory in the ring.

18. The accessory mounting mechanism of claim 12, wherein the ring further includes a shim.

19. The accessory mounting mechanism of claim 12, wherein the ring further includes at least two O-rings at either end of the ring to prevent rotation of the accessory.

20. The accessory mounting mechanism of claim 12, wherein the base further includes a recoil lug.

21. The accessory mounting mechanism of claim 12, wherein the ring further includes a plurality of serrations on the inner surface of the ring to prevent rotation of the accessory.

22. An accessory mounting mechanism for a firearm, the mounting mechanism comprising:

a top portion forming a hollow ring for accepting an accessory; and a bottom portion consisting of a clamp coupled to the ring, wherein the clamp includes:

a detachable base, wherein the sides of the base form ramps, and wherein the base comprises:

at least two anchors coupled to the firearm, at least two anchors are threaded through at least two base apertures, and a non-detachable portion comprising:

at least two anchor apertures, through which the at least two anchors are threaded to couple the base to the non-detachable portion, and two detachable wedges secured into the sides of the bottom portion below the ring, wherein a cross bar is threaded through both of the two detachable wedges and into a nut, wherein the nut is contained within a throw lever.

23. The accessory mounting mechanism of claim 22, wherein the firearm includes a KeyMod rail.

24. The accessory mounting mechanism of claim 23, wherein the clamp is tightened by moving the throw lever from a first position to a second position.

25. The accessory mounting mechanism of claim 24, wherein the second position of the throw lever applies force against the two detachable wedges and the rail simultaneously, such that the pressure against the two detachable wedges forces the accessory upward into the ring and the rail is pinched between the at least two teeth, securing the clamp to the rail.

* * * * *